United States Patent [19]

Kawarada et al.

[11] 3,952,710

[45] Apr. 27, 1976

[54] AIR-FUEL RATIO CONTROL SYSTEM FOR INTERNAL COMBUSTION ENGINES

[75] Inventors: Junji Kawarada, Kariya; Kunio Endo, Anjo; Susumu Harada, Oobu; Motoharu Sueishi, Kariya, all of Japan

[73] Assignee: Nippondenso Co., Ltd., Kariya, Japan

[22] Filed: Nov. 15, 1973

[21] Appl. No.: 416,277

[30] Foreign Application Priority Data

Nov. 17, 1972 Japan ..... 47-115934

[52] U.S. Cl. ..... 123/32 EA

[51] Int. Cl.[2] ..... F02D 5/02

[58] Field of Search ..... 123/32 EA

[56] References Cited

UNITED STATES PATENTS

| | | | |
|---|---|---|---|
| 2,934,050 | 4/1960 | Pribble | 123/32 EA |
| 3,548,792 | 12/1970 | Palmer et al. | 123/32 EA |
| 3,745,768 | 7/1973 | Zechnall et al. | 123/32 EA |
| 3,759,232 | 9/1973 | Wahl et al. | 123/32 EA |
| 3,782,347 | 1/1974 | Schmidt et al. | 123/32 EA |
| 3,815,561 | 6/1974 | Seitz | 123/32 EA |
| 3,827,237 | 8/1974 | Linder et al. | 123/32 EA |
| 3,831,564 | 8/1974 | Schmidt et al. | 123/32 EA |

*Primary Examiner*—Wendell E. Burns
*Assistant Examiner*—Joseph A. Cangelosi
*Attorney, Agent, or Firm*—Cushman, Darby & Cushman

[57] ABSTRACT

There is provided an air-fuel ratio control system for internal combustion engines wherein the direction of deviation of the actual air-fuel ratio from a preset air-fuel ratio is determined by an oxygen concentration detector for detecting the concentration of oxygen contained in the exhaust gases from an internal combustion engine and an air-fuel ratio discriminating circuit, whereby air is injected from an air injection valve when the air-fuel ratio is low i.e. the mixture is rich and fuel is injected from a fuel injection valve when the air-fuel ratio is high i.e. the mixture is lean, thereby controlling the air-fuel ratio to a predetermined value.

4 Claims, 2 Drawing Figures

AIR-FUEL RATIO CONTROL SYSTEM FOR INTERNAL COMBUSTION ENGINES

BACKGROUND OF THE INVENTION

1. Field of the Invention

The present invention relates to an air-fuel ratio control system for internal combustion engines which is designed to control the air fuel-ratio of an engine to a predetermined value.

2. Description of the Prior Art

In a known type of fuel supply system for internal combustion engines, fuel is mixed with air in a carburetor in accordance with the load on an engine to thereby supply to the engine as optimum a mixture as possible. A disadvantage of this type of fuel supply system is that due to a delay in the response and the like, it is extremely difficult with this type of fuel supply system to operate the engine with an air-fuel ratio that is varied to suit the everchanging operating conditions of the engine and hence the effeciency of exhaust gas purification is extremely deteriorated.

SUMMARY OF THE INVENTION

With a view to overcoming the foregoing difficulty, it is the object of the present invention to provide an air-fuel ratio control system for internal combustion engines which is provided with a feedback system that applies a negative feedback in such a manner that in accordance with the output of an oxygen concentration detector for detecting the concentration of oxygen contained in the exhaust gases from an engine, air is injected when the air-fuel ratio is low i.e. the mixture is rich and fuel is injected when the air-fuel ratio is high i.e. the mixture is lean, whereby to control the air-fuel ratio with improved accuracy to a predetermined value to satisfactorily suit the varying operating conditions of the engine.

According to one form of this invention, there is a remarkable advantage in that in the production of an air fuel mixture in a carburetor, after the production of a standard mixture, the direction of deviation of the air fuel ratio from a preset air-fuel ratio is determined by an oxygen concentration detector and an air-fuel ratio descriminating circuit, whereby air is injected from an air injection valve when the air-fuel ratio is high i.e. the mixture is rich and fuel is injected from a fuel injection valve when the air-fuel ratio is high i.e. the mixture is lean, thereby to operate the engine with a predetermined air-fuel ratio.

According to another form of this invention, there is a remarkable advantage in that the system according to the present invention can be used in combination with a conventional electronically controlled fuel injection system to operate the engine with a predetermined air-fuel ratio.

DESCRIPTION OF THE PREFERRED EMBODIMENTS

The present invention will now be described in greater detail with reference to the illustrated embodiments.

Figure 1:
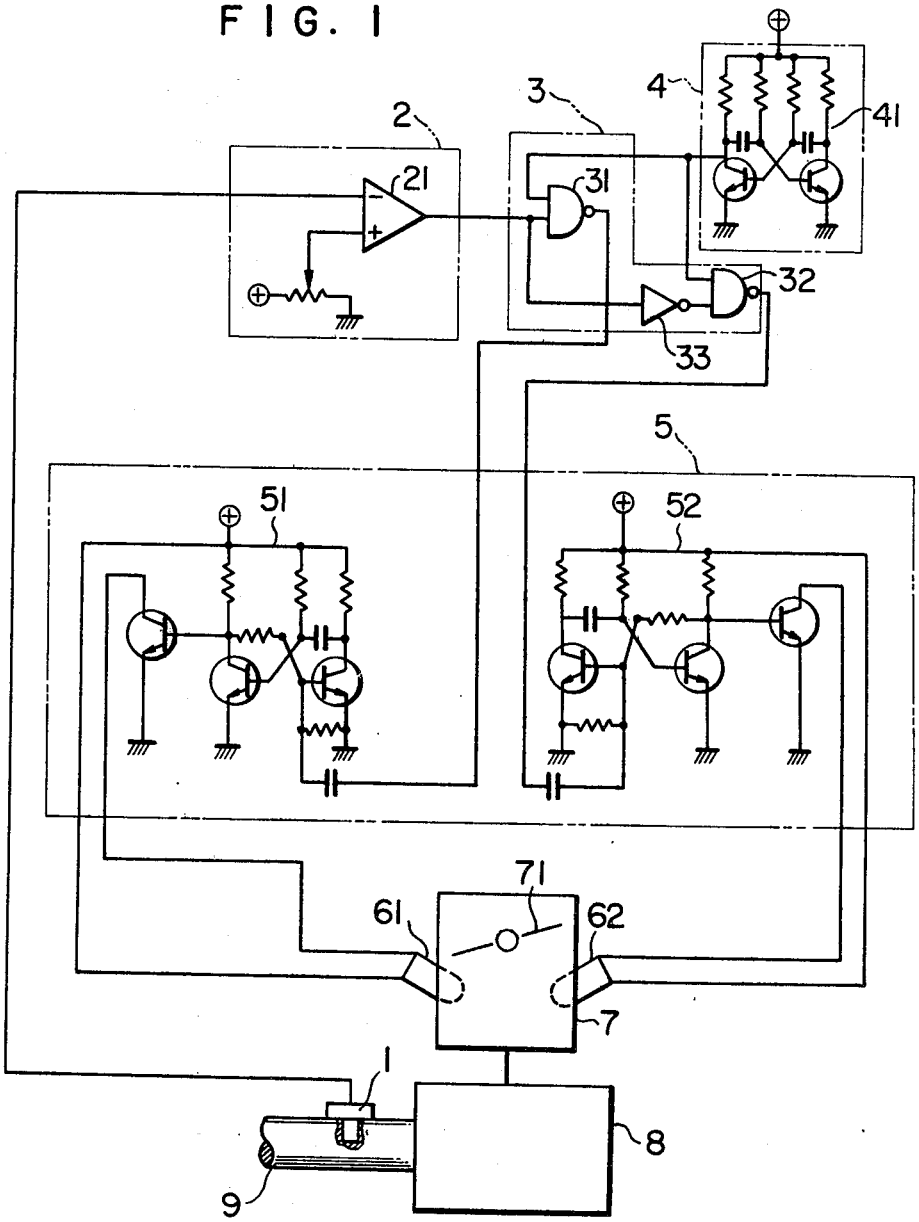
FIG. 1 is a block diagram showing a first embodiment of an air-fuel ratio control system for internal combustion engines according to the present invention.

Referring first to FIG. 1 showing a first embodiment of an air-fuel ratio control system according to the present invention, numeral 1 designates an oxygen concentration detector for detecting the concentration of oxygen contained in the exhaust gases from an internal combustion engine, which comprises a metal oxide such as zirconium dioxide or titanium dioxide so that its output voltage varies in accordance with the oxygen concentration. Numeral 2 designates an air-fuel ratio discriminating circuit comprising a comparator 21 for comparing the output of the oxygen concentration detector 1 with an air-fuel ratio setting voltage VR, whereby a discrimination output signal which is a "O" or "1" signal is generated depending on whether the concentration of oxygen in the exhaust gases is higher or lower than a predetermined oxygen concentration or a predetermined air-fuel ratio. Numeral 3 designates an injection command circuit comprising NAND circuits 31 and 32 and an inverter 33 for generating a command signal which directs the injection of air or fuel, whereby whether the injection of fuel or the injection of air should be effected is directed in accordance with the discrimination signal each time a sampling signal is applied thereto. Numeral 4 designates a sampling signal generating circuit comprising an astable multivibrator 41 for generating sampling signals having a predetermined sampling period and applying these sampling signals to the injection command circuit 3. The sampling signal generating circuit 4 may comprise for example a monostable multivibrator connected to an ignition signal generating circuit to generate sampling signals synchronized with the revolutions of the engine. Numeral 5 designates injection control means comprising monostable multivibrators 51 and 52, whereby when the injection command circuit 3 generates a command signal directing the injection of air, the monostable multivibrator 51 is triggered to generate air injection pulses whose pulse width is controlled for example in accordance with the load on the engine and this pulse width determines the duration of the opening period of an air injection valve 61, whereas when the command signal from the injection command circuit 3 directs the injection of fuel, the monostable multivibrator 52 is similarly triggered to generate fuel injection pulses whose pulse width determines the duration of the opening period of a fuel injection valve 62. Numeral 7 designates a carburetor for providing an air-fuel mixture corresponding to the load on the engine. The injection valves 61 and 62 are mounted downstream of a throttle valve 71 of the carburetor 7 and the air-fuel mixture prepared in the carburetor 7 is distributed to the respective engine cylinders through the intake manifold, thereby operating the engine with a predetermined air-fuel ratio in every region of the air-fuel ratio characteristic. Numeral 8 designates an engine, 9 an exhaust manifold.

With the construction described above, the operation of the first embodiment is as follows. When, during steady state operation, the oxygen concentration detector 1 mounted in the exhaust manifold 9 and the air-fuel ratio discriminating circuit 2 generate a discrimination signal indicating that the mixture is rich, the injection command circuit 3 generates, in accordance with the discrimination signal, a command signal directing the injection of air each time a sampling signal arrives from the sampling signal generating circuit 4. In response to this command signal, the monostable multivibrator 51 generates an air injection pulse whose pulse width is determined according to an engine parameter such as the engine vacuum, whereby the air injection valve 61 is opened to supply an additional air to increase the air-fuel ratio and cause the mixture to lean out. In this case, since the principal fuel and air are supplied from the carburetor 7, the quantity of the air and the quantity of the fuel supplied from the carburetor 7 during constant load operation of the engine are fixed and consequently the air-fuel ratio is increased in proportion to the amount of the air additionally supplied from the air injection valve 61. If the discrimination signal has not been reversed by the time when the next sampling signal is received by the injection command circuit 3, the similar process of operations as described above is repeated to regulate the air-fuel ratio to a predetermined value.

On the other hand, if the discrimination signal indicative of a lean mixture, i.e. a high air-fuel ratio is being generated by the oxygen concentration detector 1 and the air-fuel ratio discriminating circuit 2 when the sampling signal is received by the injection command circuit 3, a command signal directing the injection of fuel is generated from the injection command circuit 3 in response to the discrimination signal. Similarly in the case of the air injection, the monostable multivibrator 52 generates a fuel injection pulse in response to the command signal and thus opens the fuel injection valve 62 to supply an additional amount of fuel and thereby to decrease the air-fuel ratio.

In the manner described above, the required negative feedback control is effected to regulate the air-fuel ratio to a predetermined value by correcting the air-fuel ratio through the additional supply of air or fuel made upon the sampling operation by the sampling signal.

Further, by reducing the amount of change of the pulse width of the air and fuel injection pulses, it is possible to control the air-fuel ratio during steady state operation of the engine with improved accuracy. Furthermore, it is possible to improve the follow-up characteristic and accuracy of the feedback control by reducing the period of the sampling signals.

Figure 2:
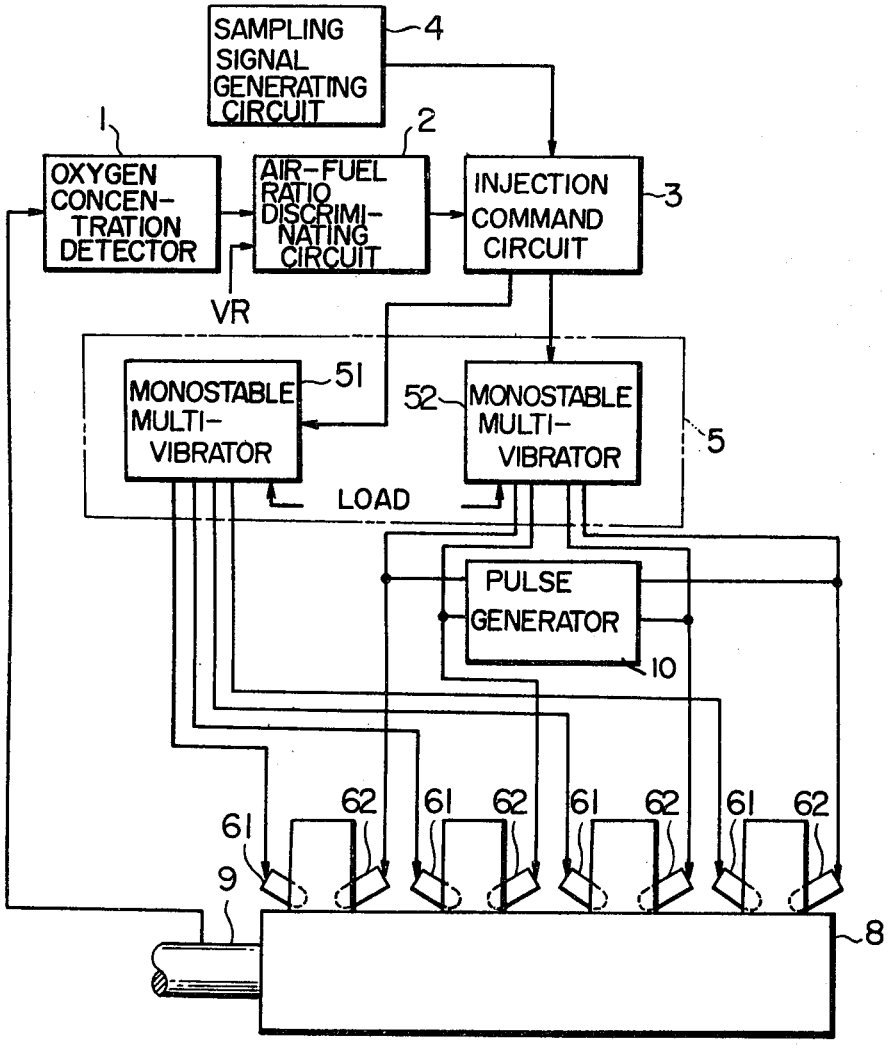
FIG. 2 is a block diagram showing a second embodiment of the air-fuel ratio control system according to the present invention.

Next, a second embodiment of the system according to the present invention will be described with reference to FIG. 2 in which the component parts identical or equivalent to those used in the first embodiment of FIG. 1 are designated by the same reference numerals. In the second embodiment, one each of the injection valves 61 and 62 are provided to correspond to each of the engine cylinders and electronically controlled fuel injection pulses generated by a pulse generator 10 and having a pulse width corresponding to several parameters such as the engine revolutions, engine temperature and intake manifold vacuum are applied to the fuel injection valves 62.

The operation for opening the fuel injection valves 62 with the said electronically controlled fuel injection pulses is the same as in the case of the conventional electronically controlled fuel injection systems. In addition to this operation, the fuel injection pulses generated by the monostable multivibrator 52 are applied to the fuel injection valves 62 independently of the pulses from the pulse generator 10 so that the fuel injection valve 62 is opened for a time corresponding to the pulse width of the pulse signal from the monostable multivibrator 52.

Further, the pulse signal from the monostable multivibrator 52 may be applied as an input to the pulse generator 10 to correct its pulse signal so that the fuel injection valve 62 is actuated by this corrected pulse signal.

We claim:

1. An air-fuel ratio control system for an internal combustion engine comprising:

an oxygen concentration detector mounted in an exhaust manifold of an internal combustion engine for detecting the concentration of oxygen contained in the exhaust gases from the engine to produce a detected signal, an air-fuel ratio discriminating circuit connected to said oxygen concentration detector for comparing the detected signal with a predetermined value to produce a discrimination signal having a first value when said discrimination signal is greater than said predetermined value and a second value when said discrimination signal is less than said predetermined value of said detected signal, a sampling signal generating circuit for generating a sequence of sampling signals at a predetermined frequency, an injection command circuit connected to said air-fuel ratio discriminating circuit and said sampling signal generating circuit for generating a first command signal for causing injection of air into the engine in response to one of said first and second values of said discrimination signal and a second command signal for causing injection of fuel in response to the other one of said first and second values every time said sampling signal is delivered to said injection command circuit, an air-injection electromagnetic valve mounted in an intake manifold of the engine for injecting air into the engine, a fuel-injection electromagnetic valve mounted in said intake manifold of the engine for injecting fuel into the engine, and injection control means connected to said injection command circuit for opening said air-injection valve in response to said first command signal and said fuel-injection valve in response to said second command signal.

2. An air-fuel ratio control system according to claim 1, further comprising:

a pulse generator connected to said fuel-injection valve for generating an injection pulse whose width varies in accordance with conditions of the engine and which is used to open said fuel-injection valve for injection of fuel.

3. An air-fuel ratio control system according to claim 1 further having a carburetor, wherein said air injection valve and fuel injection valve are mounted down stream of a throttle valve of said carburetor.

4. An air-fuel ratio control system according to claim 1, wherein said injection control means comprises a pair of multivibrators connected to said air-injection electromagnetic valve and said fuel-injection electromagnetic valve, respectively.

* * * * *